US005329951A

United States Patent [19]

Jones

[11] Patent Number: 5,329,951

[45] Date of Patent: Jul. 19, 1994

[54] CYLINDER HEAD CLEANING MACHINE

[76] Inventor: Colin H. Jones, 8 Pimpala Avenue, Seaford, Victoria, 3198, Australia

[21] Appl. No.: 58,220

[22] Filed: May 10, 1993

[51] Int. Cl.[5] ..... B08B 3/02

[52] U.S. Cl. ..... 134/104.4; 134/111; 134/144; 134/153; 134/162

[58] Field of Search ..... 134/104.4, 107, 108, 134/111, 144, 153, 157, 162, 172

[56] References Cited

U.S. PATENT DOCUMENTS

| | | | |
|---|---|---|---|
| 3,070,103 | 12/1962 | Pickard et al. | 134/144 X |
| 3,073,325 | 1/1963 | Rebizzo et al. | 134/153 X |
| 3,240,216 | 3/1966 | Sadwith | 134/80 |
| 3,656,493 | 4/1972 | Black et al. | 134/172 X |
| 3,799,178 | 3/1974 | Anderson et al. | 134/144 X |
| 3,812,622 | 5/1974 | Parsons | 134/172 X |
| 4,090,309 | 5/1978 | Rollins | 134/153 X |
| 4,256,511 | 3/1981 | Atchison et al. | 134/172 X |
| 4,585,019 | 4/1986 | Jacobson | 134/144 X |
| 4,941,491 | 7/1990 | Goerss et al. | 134/144 X |

FOREIGN PATENT DOCUMENTS

| | | | |
|---|---|---|---|
| 1108584 | 6/1961 | Fed. Rep. of Germany | 134/144 |
| 3114307 | 10/1982 | Fed. Rep. of Germany | 134/172 |

*Primary Examiner*—Philip R. Coe
*Attorney, Agent, or Firm*—Marion P. Lelong

[57] ABSTRACT

A machine for cleaning an internal combustion engine cylinder head uses a high-pressure water jet supplied by a pump driven by an electric motor or an internal combustion engine powered by a power pack and via a spinning spray nozzle head mounted on a vertically reciprocating traveller travelling the length of a cylinder head clamped by headstock and tailstock clamping assemblies each with six conical-headed, spring-loaded clamping members clamped together by a pneumatic ram and rotatable horizontally at varying speeds by a variable-speed electric motor and drive assembly in synchronization with another electric motor driving the traveller; a spinning spray jet swivel head assembly is rotated via an hydraulic motor from the power pack; clamping and spray head assemblies are mounted within in a framed cabinet and a removable wheeled waste water collection tank underneath has fixed, vertically-opposed horizontally spaced baffles for separation and settling sludge and floating scum from water which is then recycled.

14 Claims, 7 Drawing Sheets

CYLINDER HEAD CLEANING MACHINE

This invention relates generally to equipment for cleaning machine parts and automotive components such as cylinder heads and relates in particular to a machine for cleaning cylinder heads of internal combustion engines by a high pressure water jet.

BACKGROUND OF THE INVENTION

In the past, warm or hot aqueous caustic soda (sodium hydroxide) solutions have been used for cleaning grease and other residues from machine parts and automotive components and especially cylinder heads of internal combustion engines but in present times many cylinder heads are made of aluminum alloys which are attacked by caustic soda. Furthermore, waste caustic soda and other waste products from such cleaning operations is flushed into drainage thus polluting the environment and damaging the ecology. Additionally, attention is not paid to waste recovery.

It is an object of this invention to provide a machine for cleaning parts of machinery such internal combustion engine cylinder heads by using a high-pressure water jet or jets.

Another object of the invention is to provide a machine for cleaning ferrous or non-ferrous internal combustion cylinder heads by using a high-pressure water spray and which treats water from cleaning and recycles it through the machine.

A further object is to provide a pump assembly for high-pressure water spray cleaning of a cylinder head for an internal-combustion engine.

According to the invention, there is provided a machine for cleaning dirty machine parts such as an internal combustion engine cylinder head by using a high-pressure water jet or jets and which comprises a housing, means for removably supporting a cylinder head to be cleaned within the housing, at least one spray jet nozzle mounted within the housing and adapted to direct a high-pressure water spray over the machine part, and pump means for supplying high-pressure water to the at least one jet nozzle.

More particularly, the means for removably supporting the cylinder head to be cleaned comprises a pair of horizontally-rotatable, vertically opposed clamping assemblies comprising a tailstock upper clamping assembly and a headstock lower clamping assembly both clamping assemblies have spring-loaded clamping members, the means associated with the at least one high-pressure water spray jet nozzle is a vertically travelling spinning spray head mounted on a traveller sliding and reciprocating vertically along bearing guide members.

Other features, uses and advantages of the invention will become apparent from a reading of the following description of the embodiment presented in the accompanying drawings.

BRIEF DESCRIPTION OF THE DRAWINGS

A non-limiting example of a preferred embodiment of the cylinder head cleaning machine according to the invention will be described in greater detail by reference to the accompanying drawings in which like numbers refer to like parts.

DESCRIPTION OF THE ILLUSTRATED EMBODIMENT

Figure 1:
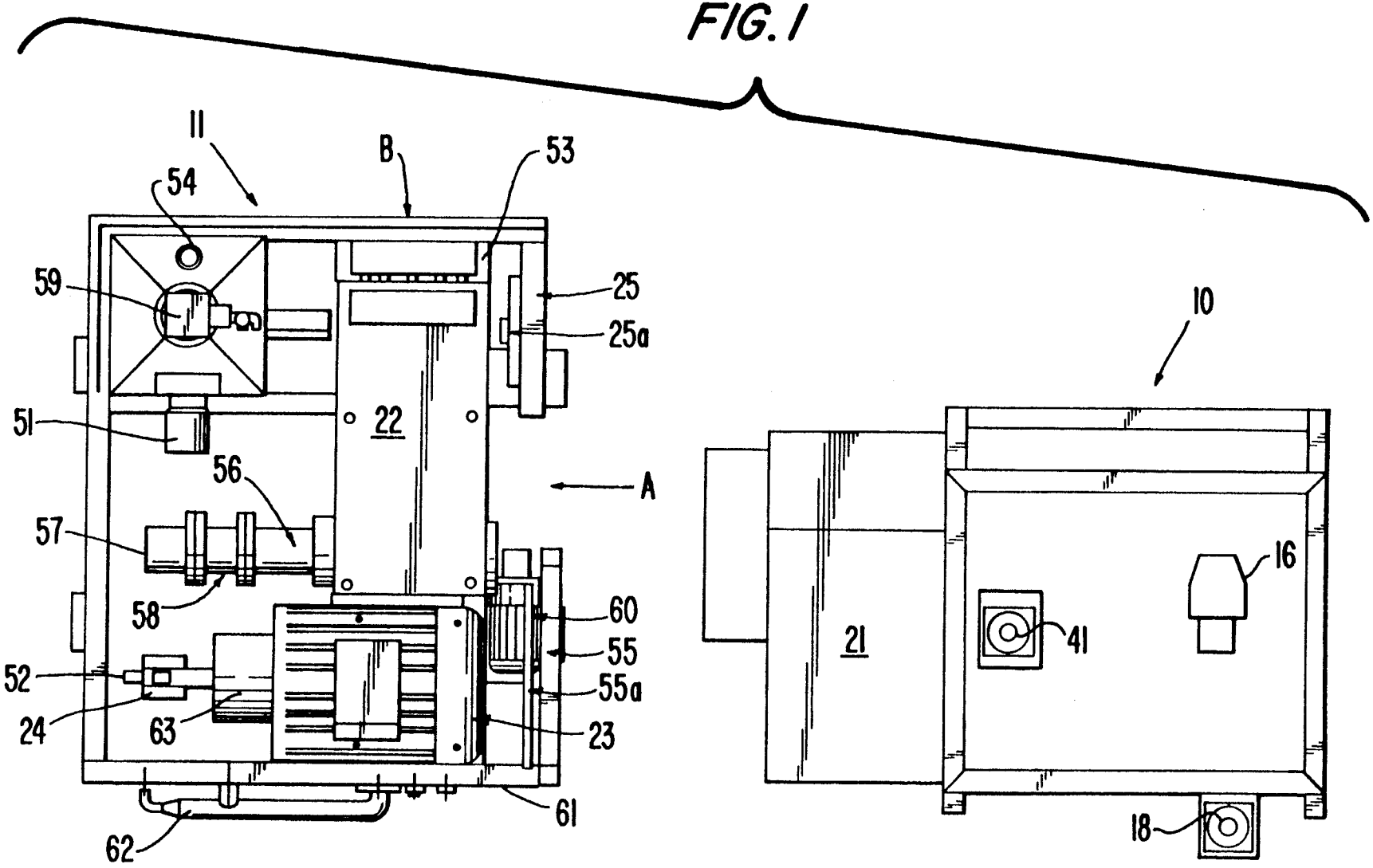
FIG. 1 is a plan view of a general layout of the machine high-pressure water spray cleaning of an internal combustion engine cylinder head.
Figure 2:
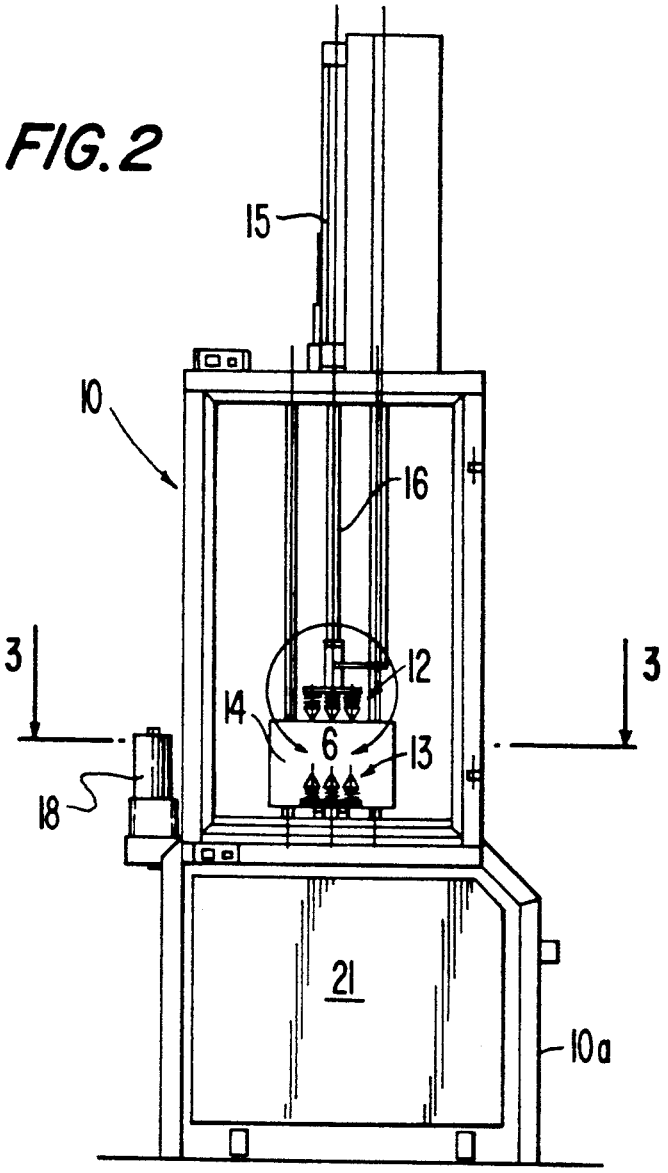
FIG. 2 is a front door-open, elevational view of the clamping and spray head assemblies for the machine of FIG. 1.
Figure 3:
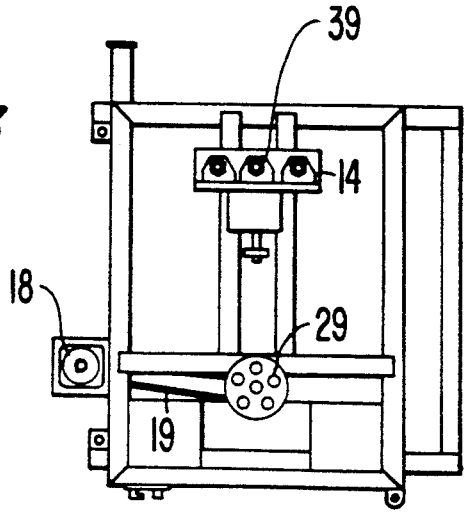
FIG. 3 is a cross-sectional view taken along the line 3—3 of FIG. 2 in the direction of the arrows.
Figure 4:
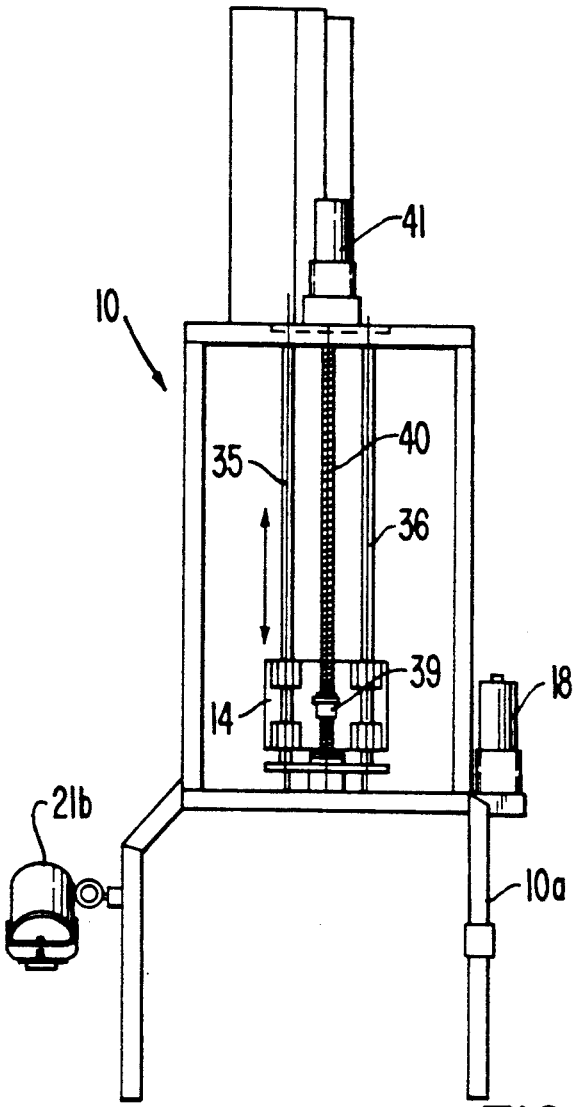
FIG. 4 is a rear elevational, panel-removed view of the spray head traveller of the machine.
Figure 5:
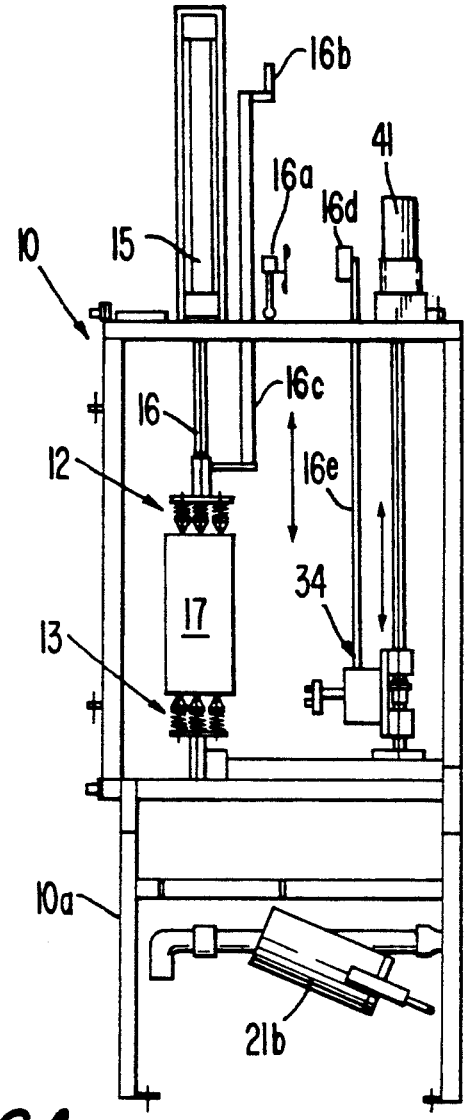
FIG. 5 is a side elevational view showing clamping assemblies and the travelling spray head assembly of the machine.
Figure 6:
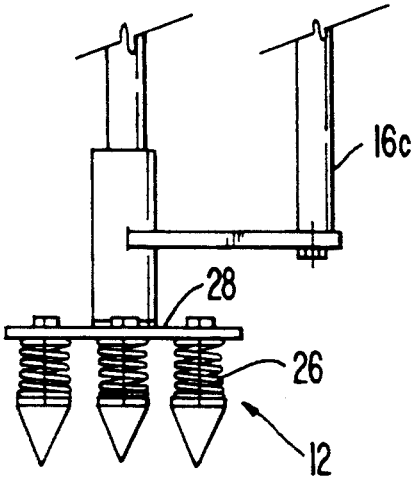
FIG. 6 is an enlarged partial elevational view of the tailstock clamping assembly encircled in FIG. 2.
Figure 6A:
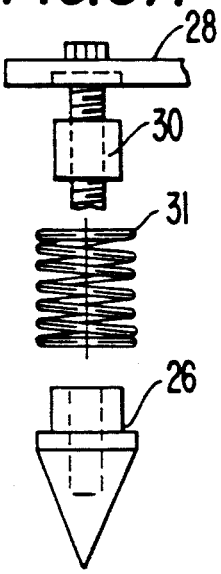
FIG. 6A is an exploded view of the part of FIG. 6.
Figure 7:
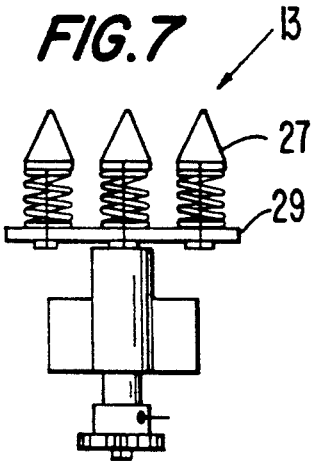
FIG. 7 is an enlarged partial view of the headstock clamping assembly 13 of FIG. 2.
Figure 8:
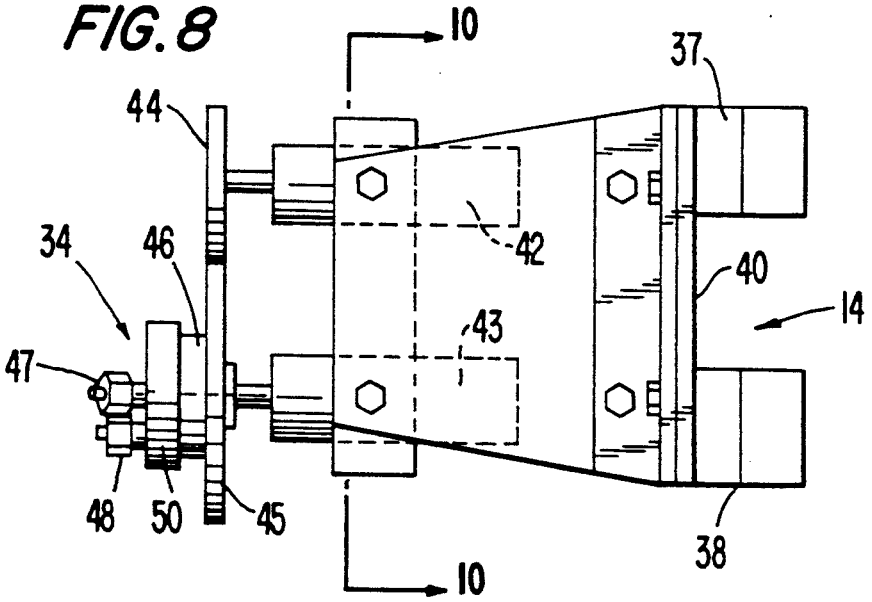
FIG. 8 is a side elevation of the spinning spray head and traveller assembly.
Figure 9:
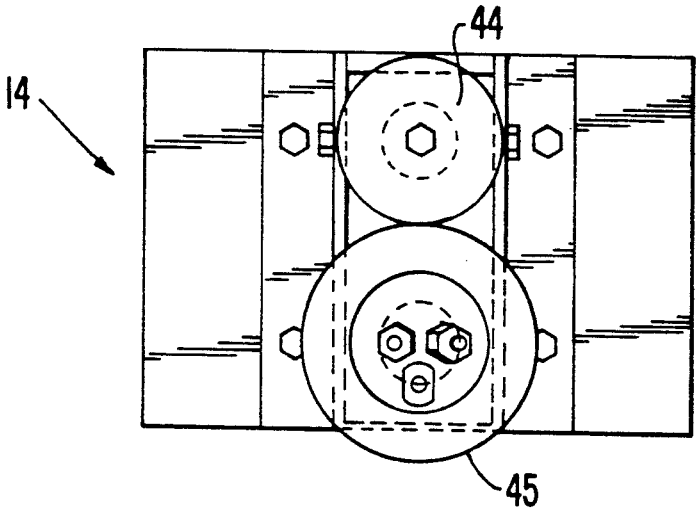
FIG. 9 is a front elevation of the assembly of FIG. 8.
Figure 10:
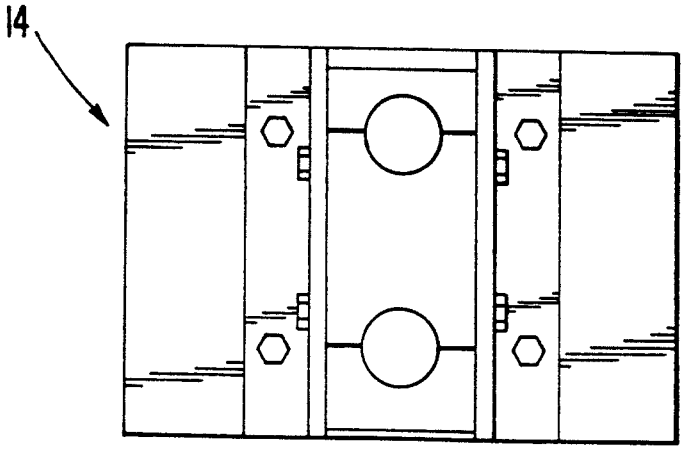
FIG. 10 is a section taken along the line marked 10—10 through the assembly of FIG. 8 the direction of the arrows.
Figure 11:
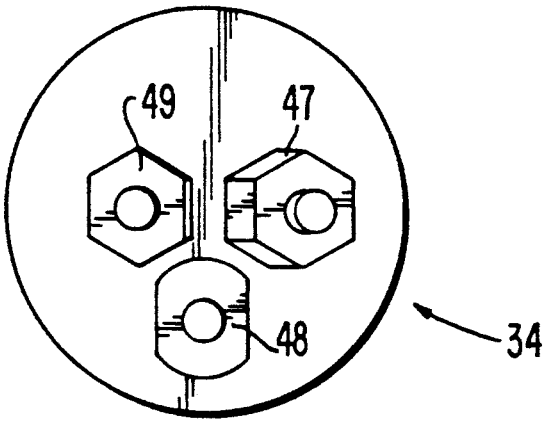
FIG. 11 is a front elevation of the spray head.
Figure 12:
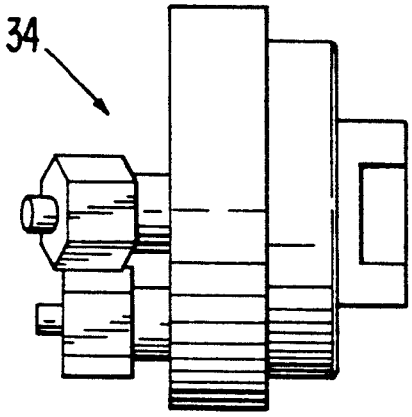
FIG. 12 is a side elevation of the spray head.
Figure 13:
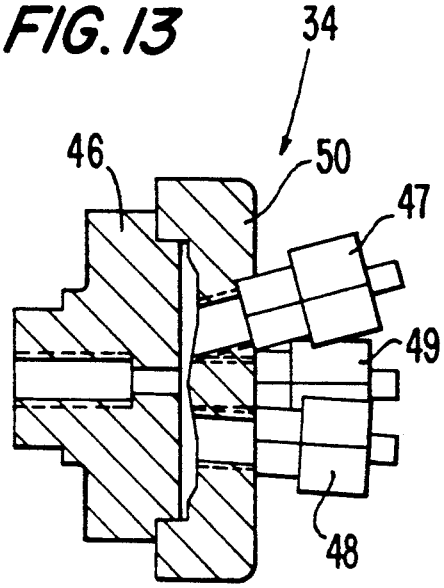
FIG. 13 is a cross section of the spray head of FIGS. 11 and 12.
Figure 14:
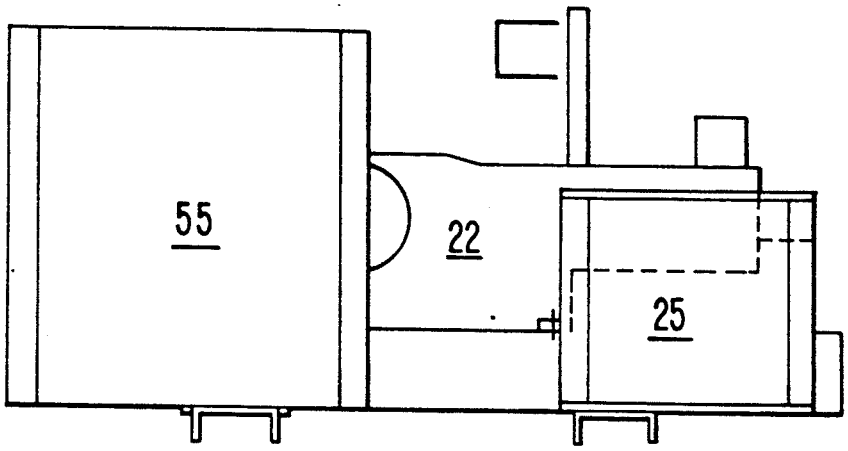
FIG. 14 is a front elevation of the high-pressure water pump assembly of FIG. 1 viewed in the direction of the arrow labelled A.
Figure 14A:
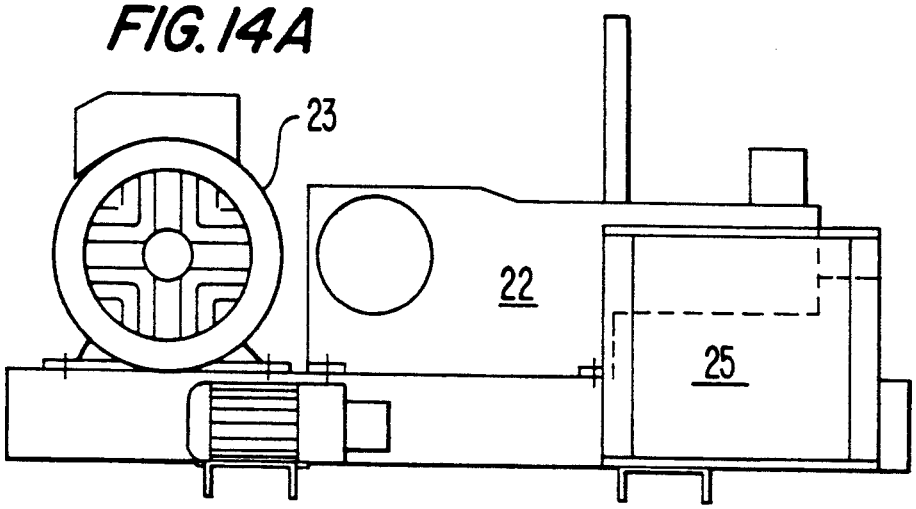
FIG. 14A is a similar view to that of FIG. 14 but with the hydraulic fluid-cooling radiator removed.
Figure 15:
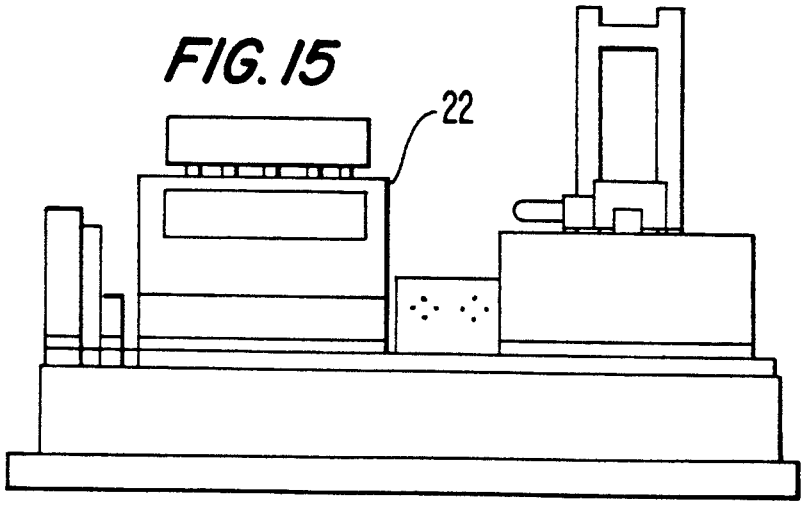
FIG. 15 is an elevation of the pump assembly of FIG. 1 viewed in the direction of the arrow labelled B.
Figure 16:
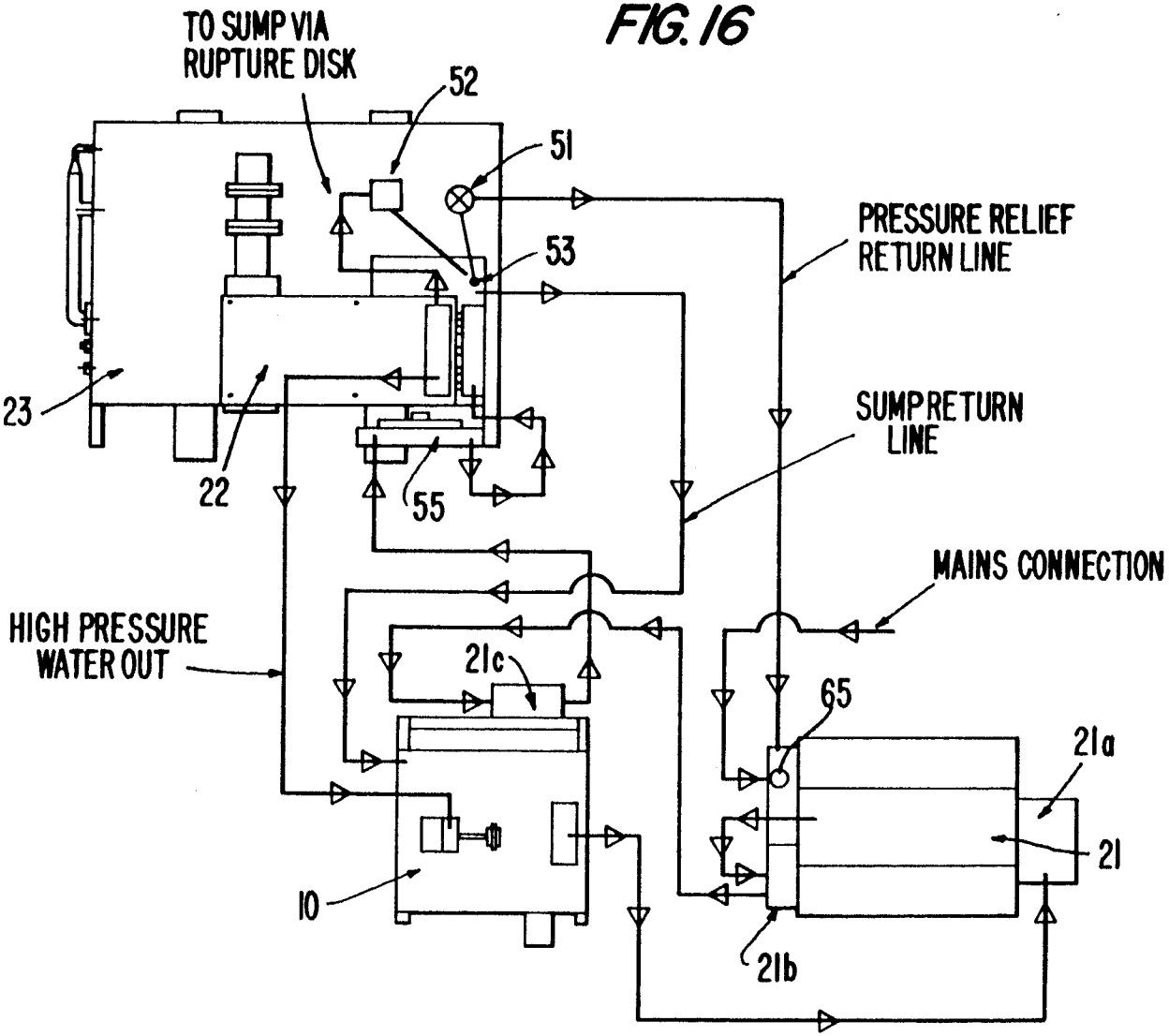
FIG. 16 is a schematic water-flow diagram for the cylinder-head cleaning machine of the invention.

Reference is now made to the drawings in which FIG. 1 is a plan view in general layout of the cylinder-head cleaning machine which is preferably adapted for automatic operation and which shows the major parts comprising a framed cleaning cabinet 10 on the right-hand side and a high-pressure water pump sub-assembly 11 on the left-hand side for supplying high-pressure water to nozzles in the cabinet 10 which contains equipment for gripping, turning and water spray cleaning of a cylinder head of an internal combustion engine by means of a high-pressure water jets. The front and door-open view of FIG. 2 has the cabinet frame showing but has panels removed and shows tailstock upper clamping assembly 12, headstock lower clamping assembly 13 and a vertical traveller 14 which carries a spinning spray head assembly described later. A pneumatic ram 15 on top of the cabinet clamps via its piston rod 16 a dirty cylinder head 17 of an internal combustion engine (see FIG. 5) in place for cleaning. A variable-speed drive assembly is provided for rotating the dirty cylinder head at variable speeds while it is clamped between clamping assemblies during high-pressure water spray cleaning and this drive assembly has a variable speed electric motor 18 which drives a bearing shaft via a chain drive assembly 19 to rotate the disc 29 of the headstock clamping assembly 13. A removable wheeled, sludge collection and water recovery and recycling tank trolley 21 is stationed underneath the cabinet 10 between frame members forming a stand 10*a* and this tank 21 has a lift-out basket 21*a* with a matrix of holes for removal of coarse particles. Waste water from the trolley is transferred via pump 21*b* to a filter 21*c*. The high-pressure water pumping sub-assembly shown in FIGS. 1, 14, 14A and 15 has a high-pressure water pump 22 delivering water to the cleaning head in excess of 8000 psi. The water pump 22 is a reciprocating, multi-parallel piston type such as that sold under the brand name and model DURAQUAL model No. WS735.135H30 and is powered by a "power pack" which includes a 100 HP induction AC electric motor 23 which powers an hydraulic pump 24, the water pump 22 is cooled by an air radiator 25 with external thermatic fan 25*a*. FIG. 5 of the accompanying drawings shows the dirty cylinder head 17 removably clamped between tailstock upper clamping assembly 12 and a tailstock lower clamping assembly 13, both assemblies comprise a plurality of internally-threaded, conically-headed, spring-loaded clamping members in this case six clamping members on each such as the one only labelled 26 (lower assembly) shown in FIG. 6 and 27 (upper assembly) shown in FIG. 7. The clamping members are arranged with a central member surrounded by five others at equal intervals about a circumferential path bolted to a horizontally rotatable circular mounting disc 28 or 29 respectively by means of attachment collars such as the one labelled 30 in FIG. 6A. The conical head portion of each clamping unit is loaded by a spring such as that shown and labelled 31, as shown in FIG. 6A. The tailstock clamping assembly is also vertically actuated for clamping and unclamping by the tailstock pneumatic ram 15. For clarity, FIGS. 2 and 5 have shown mainly in outline a travelling, high-pressure water spinning spray head sub-assembly 34 now explained in detail by referring to FIGS. 8 to 13 inclusive. FIGS. 11, 12, 13, show a spinning spray head adapted to be rotatably mounted upon the traveller 14 in a sub-assembly (FIGS. 8, 9, 10) which slides and reciprocates vertically along smooth, hardened-steel linear bearing guides 35, 36 via bushes 37 and 38 and is propelled up and down the guides by interaction between a recirculating ball nut 39 (rear view FIG. 4) on a flanged plate on the traveller 14 and a central rotating threaded lead screw 40 (FIG. 4) driven by a variable-speed drive electric motor 41 on top of the cabinet. The limits of vertical travel of the traveller 14 and with it the spray head 34 is controlled by a photo-electric cell and light beam sensor unit assembly with emitter/sensor part 16*a* fixed to the top of the cabinet, another part 16*b* is mounted on top of an arm 16*c* mounted on and moving with the ram piston 16 during clamping and unclamping movements. A mirror 16*d* rides on an arm 16*e* on the traveller spray head all of these unit components activate limit switches to control vertical movements of the clamping ram and traveller. Referring to the travelling spray head sub-assembly of FIG. 8 a hydraulic motor 42 drives a high-pressure water swivel 43 with sprocket 44 driving meshed sprocket 45 or a chain and sprocket to spin rotary nozzle holder 46 (referring to FIGS. 8, 9 and 11 to 13) which spins three tungsten-tipped, high-pressure water spray nozzles 47, 48, 49 which are threaded into the water jet impingement plate 50 in turn fixed to the rotary nozzle holder 46 which with the water spray cleaning spinning head 34 and traveller 14 travel up and down the central, dual directional rotating, vertical, threaded lead screw 40. As shown in FIG. 10, the traveller also provides a clamp for the hydraulic motor 42 and the water swivel 43. The water flow schematic diagram of FIG. 16 shows additional component items not previously mentioned and including in the pump assembly a low-pressure relief valve assembly 51, rupture disc 52 for the spinning spray nozzles, a water pump water leakage sump 53 and an oil refilling opening with cap 54 are included. Treated water recycled to the pump is cooled by passing it through radiator 25 with cooling fan 25*a*. A bell housing 56 is connected to a hydraulic motor 57 which powers the high-pressure water pump 22 via a Brevini reduction gear box 58. A return filter 59 and lubricating oil pump 60 are also fitted. The base 61 containing hydraulic fluid oil is connected via manifold 62 to the suction inlet side of the hydraulic pump 52. A bell housing 63 connects the electric motor 23 to the hydraulic oil pump 24 and an oil filler cap 54 is mounted atop the base.

Alternatively, instead of the water pump being powered by an electric motor through hydraulic pump units it could be powered by an internal combustion engine such as a six cylinder engine powered by gasoline diesel fuel or LP or natural gas and through a gear box.

I claim:

1. A machine for cleaning an internal combustion engine cylinder head by using a high-pressure water jet or jets and which comprises a housing, a pair of horizontally-rotatable, vertically opposed clamping assemblies for removably supporting a cylinder head to be cleaned within the housing, the assemblies comprising a tailstock upper clamping assembly and a headstock lower clamping assembly, each assembly having identical, spring-loaded clamping members comprising a central member surrounded by a plurality of circumferentially-spaced, clamping members arranged in a circular path upon a horizontally-rotatable disc, at least one high-pressure water jet nozzle mounted within the housing and adapted to direct a high-pressure water spray jet over the cylinder head, and high-pressure water pump means for applying high-pressure water to the at least one high-pressure water jet nozzle.

2. The machine according to claim 1 wherein an outer end of each clamping member is conical.

3. The machine according to claim 1 wherein the tailstock, upper clamping assembly is vertically reciprocatable for clamping and unclamping the cylinder head by a tailstock pneumatic ram driven from an air cylinder linear drive unit and the headstock lower clamping assembly is horizontally rotated by a drive chain powered by a variable speed motor, both clamping assemblies and a cylinder head placed therebetween being rotated at a variable speed as a unit via an electric motor and chain drive assembly during spray cleaning and wherein the at least one high-pressure water spray jet nozzle is mounted upon a spinning water-spray head mounted upon a traveller sliding and reciprocating vertically along bearing guide members.

4. The machine according to claim 3 wherein the traveller is driven by a variable-speed drive electric motor with reduction gear box.

5. The machine according to claim 3 wherein the spinning water-spray head comprises a hydraulic motor driving a rotary swivel with a sprocket driving a driven sprocket to thereby spin a rotary nozzle holder having mounted thereon a water jet impingement distribution plate, said plate having mounted thereon said at least one high-pressure, water spray nozzle.

6. The machine according to claim 3 wherein a plurality of high-pressure water spray jet nozzles are mounted upon the spinning spray head and are adapted for rotation in a vertical or inclined plane.

7. The machine according to claim 6 wherein the water jet nozzles are tungsten-tipped steel.

8. The machine according to claim 3 wherein the spinning water spray head is adapted to travel in a single pass or in multiple passes along and parallel to at least one axis of the cylinder head to be cleaned.

9. The machine according to claim 1 which includes means for collection and separation of waste products from soiled cleaning water, comprising a water treatment trolley with a wheeled collection tank removable from the housing.

10. The machine according to claim 9 which includes a removable basket with a matrix of holes therein for separation and removal of coarse waste particles.

11. The machine according to claim 9 which includes, for separation of fines from the waste water, an in-line filter between said collection tank and an inlet of said high-pressure water pump means.

12. The machine according to claim 11 which includes a transfer pump for transferring recycled water from said water treatment trolley via said filter back into an inlet of a high-pressure water pump of said high-pressure water pump means.

13. The machine according to claim 9 wherein the wheeled collection tank is also a water recycle tank for recycling water back into a pumping and cleaning circuit.

14. The machine according to claim 1 wherein the high-pressure water pump means delivers water to the spinning water-spray cleaning head in excess of 8000 psi, and comprises a reciprocating, multi-parallel piston type pump driven by an hydraulic pump powered by a induction AC electric motor and via a reduction gear box, and wherein another hydraulic pump, driven from the electric motor through another gear box, drives a separate hydraulic motor carried by a traveller sliding and reciprocating vertically along bearing guide members within the housing to spin nozzles of a spinning spray head carried by the traveller and delivering high pressure water-cleaning water spray jets from said nozzles.

* * * * *